US010683605B2

(12) United States Patent
Ivy et al.

(10) Patent No.: US 10,683,605 B2
(45) Date of Patent: Jun. 16, 2020

(54) SOIL REPELLANT FIBER AND METHODS OF MAKING THE SAME

(71) Applicant: INVISTA TECHNOLOGIES S.A.R.L., St. Gallen (CH)

(72) Inventors: Michele A. Ivy, Columbia, SC (US); Kelcey N. Charles, Lugoff, SC (US); Isaac K. Iverson, Columbia, SC (US); Sundar Mohan Rao, Chattanooga, TN (US)

(73) Assignee: INVISTA North America S.a.r.l., Wilmington, DE (US)

( * ) Notice: Subject to any disclaimer, the term of this patent is extended or adjusted under 35 U.S.C. 154(b) by 0 days.

(21) Appl. No.: 15/036,245

(22) PCT Filed: Nov. 14, 2014

(86) PCT No.: PCT/US2014/065691

§ 371 (c)(1),
(2) Date: May 12, 2016

(87) PCT Pub. No.: WO2015/073814

PCT Pub. Date: May 21, 2015

(65) Prior Publication Data

US 2016/0298288 A1 Oct. 13, 2016

Related U.S. Application Data

(60) Provisional application No. 61/904,217, filed on Nov. 14, 2013.

(51) Int. Cl.

| | |
|---|---|
| ***D06M 11/77*** | (2006.01) |
| ***D06M 23/08*** | (2006.01) |
| ***D06M 11/79*** | (2006.01) |
| *D06M 101/32* | (2006.01) |
| *D06M 101/34* | (2006.01) |

(52) U.S. Cl.
CPC ..... *D06M 11/77* (2013.01); *D06M 11/79* (2013.01); *D06M 23/08* (2013.01); *D06M 2101/32* (2013.01); *D06M 2101/34* (2013.01); *D06M 2200/01* (2013.01); *D06M 2200/30* (2013.01)

(58) Field of Classification Search
USPC ..... 442/93; 977/773, 775
See application file for complete search history.

(56) References Cited

U.S. PATENT DOCUMENTS

| | | | | |
|---|---|---|---|---|
| 3,033,699 | A | 5/1962 | Aarons et al. | |
| 3,398,182 | A | 8/1968 | Guenthner et al. | |
| 3,574,791 | A | 4/1971 | Sherman et al. | |
| 4,024,178 | A | 5/1977 | Landucci | |
| 4,147,851 | A | 4/1979 | Raynolds | |
| 4,402,317 | A | 9/1983 | Martin | |
| 4,540,497 | A | 9/1985 | Chang et al. | |
| 4,606,737 | A | 8/1986 | Stern | |
| 2011/0072587 | A1 | 3/2011 | Cao et al. | |
| 2011/0200784 | A1* | 8/2011 | Agarwal | D01F 1/07 428/97 |
| 2011/0311757 | A1* | 12/2011 | Iverson | D06M 11/00 428/85 |
| 2012/0077725 | A1* | 3/2012 | Wang | C11D 3/227 510/285 |

FOREIGN PATENT DOCUMENTS

| | | | |
|---|---|---|---|
| CN | 102639673 | A | 8/2012 |
| CN | 103732730 | A | 4/2014 |
| DE | 1419389 | A1 | 10/1968 |
| EP | 3068942 | A1 | 9/2016 |
| JP | 05-286009 | A | 11/1993 |
| JP | 2012-500305 | A | 1/2012 |
| WO | 2013/116486 | A1 | 8/2013 |
| WO | 2015/073814 | A1 | 5/2015 |

OTHER PUBLICATIONS

International Search Report and Written Opinion Received for PCT Application No. PCT/US2014/065691, dated Apr. 30, 2015, 13 pages.
International Preliminary Report on Patentability Report Received for PCT Patent Application No. PCT/US2014/065691, dated May 26, 2016, 12 pages.

* cited by examiner

*Primary Examiner* — Matthew D Matzek

(57) ABSTRACT

A fiber and method for making the same is disclosed that comprises a surface treatment, wherein the surface treatment comprises at least one clay nanoparticle component present in an amount greater than 2000 ppm on the surface of the fiber. Also disclosed is a fiber and method for making the same, comprising a surface treatment, wherein the surface treatment comprises at least one clay nanoparticle component and excludes flourochemicals.

22 Claims, No Drawings

SOIL REPELLANT FIBER AND METHODS OF MAKING THE SAME

FIELD OF THE INVENTION

The invention relates to soil repellent fibers comprising clay nanoparticles. Also disclosed herein are processes for making the soil repellent fibers.

BACKGROUND OF THE TECHNOLOGY

Textiles that include fiber, such as carpet, are often exposed to a variety of different substances that stain and soil, and ultimately diminish their appearance. These staining and soiling substances can be hydrophilic and/or hydrophobic in nature.

For this reason, stain and soil repellent chemicals are often applied during the production of textiles, including carpets and textile products used for upholstery, bedding, and other textiles. Anti-soil treatments of such textiles have primarily been based on variations of highly fluorinated polymers, which, among other effects, tend to reduce the surface energy of the fibers resulting in a decrease in the soiling of the textiles. A considerable disadvantage of such fluorinated polymers is their high cost, due in part to the raw material supplies required for their production. Moreover, there is an increasing interest in the carpet and textile floor covering industry to replace the presently used C6-fluorochemicals with fluorine-free soil resistant and water repellent products. Eco labels such as "Blue Angel," which is awarded by RAL gGmbH, St. Augustin, Germany and others are continuously reinforcing this trend.

Non-fluorinated polymers or materials have also been developed to treat textiles, especially carpets, to reduce soiling. Examples include silicones, silicates, and certain silsesquioxanes.

However, these non-fluorinated compositions generally do not provide the same soil and water-repellent effects on textiles compared to the fluorinated polymers. They are, however, much more readily sourced from raw materials, thus further improvements using silicon-based materials is advantageous.

SUMMARY OF THE INVENTION

There is a desire to reduce or eliminate the overall usage of fluorochemicals for environmental and cost reasons. Thus, it can be understood that soil repellent fibers that contain a reduced amount of or more no fluorochemicals, but still retain good soil-resistance, are in demand.

In one nonlimiting aspect of the present invention, a fiber is disclosed comprising a surface treatment, wherein the surface treatment comprises at least one clay nanoparticle component present in an amount greater than 2000 ppm on the surface of the fiber.

In one nonlimiting embodiment of the present invention, the at least one clay nanoparticle component is selected from the group consisting of: montmorillonite, bentonite, pyrophyllite, hectorite, saponite, sauconite, nontronite, talc, beidellite, volchonskoite, vermiculite, kaolinite, dickite, antigorite, anauxite, indellite, chrysotile, bravaisite, suscovite, paragonite, biotite, corrensite, penninite, donbassite, sudoite, pennine, sepiolite, polygorskyte, and combinations thereof. In another nonlimiting embodiment, the at least one clay nanoparticle component is synthetic. In yet another nonlimiting embodiment, the at least one clay nanoparticle component is synthetic hectorite.

In another nonlimiting embodiment, the surface treatment further comprises a fluorochemical, wherein said fluorochemical is present in an amount that results in a surface fluorine content from about 0 ppm to about 50 ppm on the surface of the fiber.

In another nonlimiting embodiment, the at least one clay nanoparticle is synthetic hectorite in an amount from about 2500 ppm to about 15,000 ppm on the surface of the fiber. In yet another nonlimiting embodiment, the at least one clay nanoparticle is synthetic hectorite in an amount from about 4000 ppm to about 10,000 ppm on the surface of the fiber.

In another nonlimiting embodiment, the fiber is comprised of at least one polyamide resin selected from the group consisting of nylon 6,6, nylon 6, nylon 7, nylon 11, nylon 12, nylon 6,10, nylon 6,12, nylon 6,12, nylon DT, nylon 6T, nylon 6I and blends or copolymers thereof. In another nonlimiting embodiment, the at least one polyamide resin is nylon 6,6.

In another nonlimiting embodiment, the fiber is comprised of at least one polyester resin selected from the group consisting of polyethylene terephthalate, polytrimethylene terephthalate, polybutylene terephthalate, polyethylene naphthalate and blends or copolymers thereof. In another nonlimiting embodiment, the at least one polyester resin is polyethylene terephthalate.

In another nonlimiting embodiment, the fiber may comprise a component selected from the group consisting of silicones, optical brighteners, antibacterial components, anti-oxidant stabilizers, coloring agents, light stabilizers, UV absorbers, base dyes, and acid dye, and combinations thereof.

In another nonlimiting embodiment, a textile comprising fibers of the present invention is disclosed. In another nonlimiting embodiment, a carpet comprising fibers of the present invention is disclosed. In a nonlimiting embodiment, the carpet has a Delta E of about 85% or less than that of an untreated carpet when measured using ASTM D6540. In another nonlimiting embodiment, the carpet has a Delta E is about 50% or less than that of an untreated carpet when measured using ASTM D6540.

In a nonlimiting embodiment, the flame retardancy of the carpet is improved by about 10% or better when compared to an untreated carpet, wherein the flame retardancy is measured by critical radiant flux using ASTM method E648. In another nonlimiting embodiment, the flame retardancy of the carpet is improved by about 30% or better when compared to an untreated carpet, wherein the flame retardancy is measured by critical radiant flux using ASTM method E648.

In nonlimiting aspect of the present invention, a method of making a fiber is disclosed comprising applying a surface treatment on the fiber, wherein the surface treatment comprises at least one clay nanoparticle component present in an amount greater than 2000 ppm on the surface of the fiber and heat curing the fiber.

In one nonlimiting embodiment, the surface treatment is applied using a technique selected from the group consisting of spraying, dipping, exhaustive application, coating, foaming, painting, brushing, and rolling. In one nonlimiting embodiment, the surface treatment is applied by spraying.

DETAILED DESCRIPTION OF THE INVENTION

Some aspects provide soil repellent fibers, such as those used in carpeting. The fibers are prepared by applying a soil repellent composition comprising at least one clay nanoparticle component, wherein the soil repellent composition is present in an amount greater than 2000 ppm on the surface of the fiber. In another aspect, the soil repellent fiber comprises at least one clay nanoparticle component and excludes the use of flourochemicals. In other aspects methods of making soil repellent fibers are disclosed. In addition, in other aspects of the present invention, textiles and carpets made from the soil repellant fibers are disclosed.

All patents, patent applications, test procedures, priority documents, articles, publications, manuals, and other documents cited herein are fully incorporated by reference to the extent such disclosure is not inconsistent with this invention and for all jurisdictions in which such incorporation is permitted.

Nanoparticles, as a general class of chemical molecules, are known to extend the soiling protection properties provided by fluorine containing chemicals. As disclosed in U.S. patent application No. 2011/0311757 A1, herein incorporated by reference, nanoparticle treatments have been used previously as both a fiber softener, and as a fluorine extender for anti-soiling purposes. WO2013/116486, herein incorporated reference, teaches nanoparticles shown to have anti-soiling properties when used in conjunction with non-fluorinated chemicals having water repellent properties. The nanoparticles disclosed in WO2013/116486 are taught as extending the efficacy of fluorochemicals, and as producing a fiber having a softer hand, while retaining desirable soil-resistant attributes.

However, the prior art fails to disclose the use of clay nanoparticles as the only treatment on carpet for soiling protection. The applicants have surprisingly found that applying clay nanoparticles in an amount greater than 2000 ppm can result in desired anti-soiling properties. This is a significant discovery because it eliminates the need for additional economic costs, processing steps and equipment and environmental concerns involved with the use of flourochemicals or other water repellant applications (i.e. microcrystalline waxes). Moreover, the application of clay nanoparticles taught in aspects herein, does not affect the hand of the carpet.

In one aspect of the present invention, a soil repellent fiber is disclosed comprising a surface treatment comprising at least one clay nanoparticle. The clay nanoparticle can refer to particles substantially comprising minerals of the following geological classes: smectites, kaolins, illites, chlorites, and attapulgites. These classes include specific clays such as montmorillonite, bentonite, pyrophyllite, hectorite, saponite, sauconite, nontronite, talc, beidellite, volchonskoite, vermiculite, kaolinite, dickite, antigorite, anauxite, indellite, chrysotile, bravaisite, suscovite, paragonite, biotite, corrensite, penninite, donbassite, sudoite, pennine, sepiolite, and polygorskyte. The clay nanoparticles can be either synthetic or natural, including synthetic hectorite, and Laponite® from BYK Additives (BYK-Chemie GmbH, Wesel, Germany). The Laponite® clay nanoparticles are synthetic hectorites, and are commercially available under the names Laponite® RD, Laponite® RDS, Laponite® JS, Laponite® S482 and Laponite® SL25, for example.

Without being bound by any particular theory, it is believed that the properties of the clay nanoparticles used have an effect on their ability to impart soil repellency properties be compatible properties on fibers, yarns, textiles or carpets. In nonlimiting embodiments, the clay nanoparticles used may have a disc shape. In another nonlimiting embodiment, the clay nanoparticles used may have a disc shape and a diameter in the range of about 10 nm to about 75 nm. In another nonlimiting embodiment, the clay nanoparticles used may have a disc shape and a thickness in the range of 0.5 nm to 2 nm. In another nonlimiting embodiment, the clay nanoparticles used may have a disc shape and a diameter of about 25 nm and a thickness of about 1 nm. In another nonlimiting embodiment, the surface of the clay nanoparticles may have a negative charge in the range between about 30 mmol/100 g to about 70 mmol/100 g. In another nonlimiting embodiment, the edges of the surface of the clay nanoparticles may have small localized charges in the range between about 2 mmol/100 g to about 8 mmol/100 g. In another nonlimiting embodiment, the surface of the clay nanoparticles may have a negative charge of in the range between about 50 mmol/100 g to about 55 mmol/100 g and the edges of the surface of the clay nanoparticles may have small localized charges of in the range of about 4 mmol/100 g to about 5 mmol/100 g.

In some aspects of the surface treatment further comprises a fluorochemical, wherein said fluorochemical is present in an amount that results in a surface fluorine content from about 0 ppm to about 50 ppm OWF. The fluorochemicals can include any liquid containing at least one dispersed or emulsified fluorine containing polymer or oligomer. The liquid can also contain other non-fluorine containing compounds. Examples of fluorochemical compositions used in the disclosed composition include anionic, cationic, or nonionic fluorochemicals such as the fluorochemical allophanates disclosed in U.S. Pat. No. 4,606,737; fluorochemical polyacrylates disclosed in U.S. Pat. Nos. 3,574,791 and 4,147,851; fluorochemical urethanes disclosed in U.S. Pat. No. 3,398,182; fluorochemical carbodiimides disclosed in U.S. Pat. No. 4,024,178; and fluorochemical guanidines disclosed in U.S. Pat. No. 4,540,497. The above listed patents are hereby incorporated by reference in their entirety. A short chain fluorochemical with less than or equal to six fluorinated carbons bound to the active ingredient polymer or surfactant can also be used. The short chain fluorochemicals can be made using fluorotelomer raw materials or by electrochemical fluorination. Another fluorochemical that can be used in the disclosed composition is a fluorochemical emulsion sold as Capstone RCP® from DuPont.

The disclosed surface treatments can be applied to various types of fibers. The fiber can be any natural or synthetic fiber, including cotton, silk, wool, rayon, polyamide, acetate, olefin, acrylic, polypropylene, and polyester. The fiber can also be polyhexamethylene diamine adipamide, polycaprolactam, nylon 6,6 or nylon 6. The fibers can be spun into yarns or woven into various textiles. Yarns can include low oriented yarn, partially oriented yarn, fully drawn yarn, flat drawn yarn, draw textured yarn, air-jet textured yarn, bulked continuous filament yarn, and spun staple. Textiles can include carpets and fabrics, wherein carpets can include cut pile, twisted, woven, needlefelt, knotted, tufted, flatweave, frieze, Berber, and loop pile. Alternatively, the disclosed soil repellency composition can be applied to a yarn or textile, instead of the fiber.

Due to the ability of the clay nanoparticles of the present disclosure to form a protective film, the nanoparticle will coat any fiber surface. As such, a fiber surface, produced from polypropylene, nylon 6, nylon 6,6, polyethylene terephthalate, or polypropylene terephthalate, for example, can be treated with high levels of clay nanoparticles. As such, the fiber surface will have benefits such as soiling performance, and flame retardency benefits of the present disclosure. Towards the latter benefit, a fiber surface, such as polypropylene, nylon 6, nylon 6,6, polyethylene terephthalate, or polypropylene terephthalate, for example, when coated with high concentrations of clay nanoparticle, can form a char layer in the presence of flame, resulting in fire retardant properties for the treated fiber.

Suitable polyamide resins include those selected from the group consisting of nylon 6,6, nylon 6, nylon 7, nylon 11, nylon 12, nylon 6,10, nylon 6,12, nylon 6,12, nylon DT, nylon 6T, nylon 6I and blends or copolymers thereof. In a nonlimiting embodiment of the current invention, the at least one polyamide resin is nylon 6,6.

Suitable polyamide resins include those selected from the group consisting of polyethylene terephthalate, polytrimethylene terephthalate, polybutylene terephthalate, polyethylene naphthalate and blends or copolymers thereof. In a nonlimiting embodiment of the current invention, the at least one polyester resin is polyethylene terephthalate.

Additional components can be added to the soil repellent fiber disclosed above. Such components can include silicones, optical brighteners, antibacterial components, antioxidant stabilizers, coloring agents, light stabilizers, UV absorbers, base dyes, and acid dyes. Optical brighteners can include a triazine type, a coumarin type, a benzoxaxole type, a stilbene type, and 2,2'-(1,2-ethenediyldi-4,1 phenylene) bisbenzoxazole, where the brightener is present in an amount by weight of total composition from about 0.005% to about 0.2%. Antimicrobial components can include silver containing compounds, where the antimicrobial component is present in an amount by weight of total composition from about 2 ppm to about 1%.

In one nonlimiting aspect of the present invention the clay nanoparticles can be present in an amount greater than 2000 ppm OWF on the surface of the fiber, yarn, textile or carpet. In another nonlimiting embodiment of the present invention the clay nanoparticles can be present in an amount greater than 4000 ppm OWF on the surface of the fiber, yarn, textile or carpet. In a nonlimiting embodiment, the clay nanoparticles can be present in an amount from about 2500 ppm to about 15,000 ppm on the surface of the fiber, yarn, textile or carpet. In a nonlimiting embodiment, the clay nanoparticles can be present in an amount from about 3000 ppm to about 10,000 ppm on the surface of the fiber, yarn, textile or carpet. In a nonlimiting embodiment, the clay nanoparticles can be present in an amount from about 4500 ppm to about 8,000 ppm on the surface of the fiber.

In one nonlimiting embodiment, the soil repellent fiber comprises synthetic hectorite present in an amount greater than 2000 ppm OWE on the surface of the fiber. In another nonlimiting embodiment, the soil repellent fiber comprises synthetic hectorite present in an amount greater than 2500 ppm OWF on the surface of the fiber. In yet another nonlimiting embodiment, the soil repellent fiber comprises synthetic hectorite present in an amount greater than 4000 ppm OWF on the surface of the fiber.

In aspects of the present invention, carpets formed from the soil repellent fibers disclosed herein show improvement in soil repellency over untreated carpets made with the same construction and fiber types. Examples 1-10 below exhibit soil repellency data for carpets of various fiber types and carpet constructions. In one nonlimiting embodiment, carpets are disclosed wherein the Delta E is about 85% or less than that of an untreated carpet when measured using ASTM D6540. In one nonlimiting embodiment, carpets are disclosed wherein the Delta E is about 50% or less than that of an untreated carpet when measured using ASTM D6540.

In aspects of the present invention, carpets formed from the soil repellent fibers disclosed herein show improvement in flame retardancy over untreated carpets made with the same construction and fiber types. Examples 11-13 below exhibit flame retardancy data for carpets of various fiber types and carpet constructions. In one nonlimiting embodiment, carpets are disclosed wherein the flame retardancy is improved by about 10% or better when compared to an untreated carpet, wherein the flame retardancy is measured by critical radiant flux using ASTM method E648. In another nonlimiting embodiment, carpets are disclosed wherein the flame retardancy is improved by about 30% or better when compared to an untreated carpet, wherein the flame retardancy is measured by critical radiant flux using ASTM method E648. In another nonlimiting embodiment, carpets are disclosed wherein the flame retardancy is improved by about 50% or better when compared to an untreated carpet, wherein the flame retardancy is measured by critical radiant flux using ASTM method E648.

In another aspect of the present invention, methods for making soil repellent fibers are disclosed. In one nonlimiting embodiment, the method comprises applying a surface treatment on the fiber, wherein the surface treatment comprises at least one clay nanoparticle component present in an amount greater than 2000 ppm on the surface of the fiber and heat curing the fiber.

The disclosed surface treatments can be applied using various techniques known in the art. Such techniques include spraying, dipping, exhaustive application, coating, foaming, painting, brushing, and rolling the soil repellency composition onto the fiber. In one embodiment, the surface treatment is applied by spraying. The surface treatment can also be applied on the yarn spun from the fiber, a textile made from the fiber, or a carpet made from the fiber. In a nonlimiting embodiment, after application, the fiber, yarn, textile or carpet is then heat cured at a temperature of from about 25° C. to about 200° C. In another nonlimiting embodiment, the fiber, yarn, textile or carpet is then heat cured at a temperature of from about 150° C. to about 160° C. In a nonlimiting embodiment the time to heat cure is from about 10 seconds to about 40 minutes. In a nonlimiting embodiment, the time to heat cure is about 5 minutes.

In another nonlimiting aspect of the present invention, the applicants have surprisingly found that a soil repellent fiber could be applying clay nanoparticles without the use of fluorochemicals. This is a significant discovery because it eliminates the need for additional economic costs, processing steps and equipment and environmental concerns involved with the use of flourochemicals or other water repellant applications (i.e. microcrystalline waxes). Moreover, the application of clay nanoparticles taught in aspects herein, does not affect the hand of the carpet.

In one nonlimiting aspect of the present invention, a fiber is disclosed comprising a surface treatment, wherein the surface treatment comprises at least one clay nanoparticle component and excludes flourochemicals.

In another nonlimiting aspect of the present invention the clay nanoparticles can be present in an amount greater than 2000 ppm OWF on the surface of the fiber, yarn, textile or carpet, and excludes the use of fluorochemicals. In another nonlimiting embodiment of the present invention the clay nanoparticles can be present in an amount greater than 4000 ppm OWF on the surface of the fiber, yarn, textile or carpet, and excludes the use of fluorochemicals. In a nonlimiting embodiment, the clay nanoparticles can be present in an amount from about 2500 ppm to about 15,000 ppm on the surface of the fiber, yarn, textile or carpet, and excludes the use of fluorochemicals. In a nonlimiting embodiment, the clay nanoparticles can be present in an amount from about 3000 ppm to about 10,000 ppm on the surface of the fiber, yarn, textile or carpet, and excludes the use of fluorochemicals. In a nonlimiting embodiment, the clay nanoparticles can be present in an amount from about 4500 ppm to about 8,000 ppm on the surface of the fiber, and excludes the use of fluorochemicals.

In one nonlimiting embodiment, the soil repellent fiber comprises synthetic hectorite present in an amount greater than 2000 ppm OWF on the surface of the fiber, and excludes the use of fluorochemicals. In another nonlimiting embodiment, the soil repellent fiber comprises synthetic hectorite present in an amount greater than 2500 ppm OWF on the surface of the fiber, and excludes the use of fluorochemicals. In yet another nonlimiting embodiment, the soil repellent fiber comprises synthetic hectorite present in an amount greater than 4000 ppm OWF on the surface of the fiber, and excludes the use of fluorochemicals.

In another aspect of the present invention, methods for making soil repellent fibers are disclosed. In one nonlimiting embodiment, the method comprises applying a surface treatment on the fiber, wherein the surface treatment comprises at least one clay nanoparticle component and excludes fluorochemicals and heat curing the fiber.

Definitions

While mostly familiar to those versed in the art, the following definitions are provided in the interest of clarity.

As used herein, the term "fiber" refers to filamentous material that can be used in fabric and yarn as well as textile fabrication. One or more fibers can be used to produce a fabric or yarn. The yarn can be fully drawn or textured according to methods known in the art. In an embodiment, the face fibers can include bulked continuous filament (BCF) or staple fibers for tufted or woven carpets.

As used herein, the term "carpet" may refer to a structure including face fiber and a backing. A primary backing may have a yarn tufted through the primary backing. The underside of the primary backing can include one or more layers of material (e.g., coating layer, a secondary backing, and the like) to cover the backstitches of the yarn. In general, a tufted carpet includes a pile yarn, a primary backing, a lock coat, and a secondary backing. In general, a woven carpet includes a pile yarn, a warp, and weft skeleton onto which the pile yarn is woven, and a backing. Embodiments of the carpet can include woven, non-wovens, and needle felts. A needle felt can include a backing with fibers attached as a non-woven sheet. A non-woven covering can include backing and a face side of different or similar materials.

The term "flame retardant" is defined as not susceptible to combustion to the point of propagating a flame, beyond safe limits, after the ignition source is removed.

The term "flame-retardant carpet" is used herein to mean that the carpet self-extinguishes under carefully controlled conditions after being ignited.

Abbreviations

While mostly familiar to those versed in the art, the following abbreviations are provided in the interest of clarity.

Nanoparticle: A multidimensional particle in which one of its dimensions is less than 100 nm in length.

OWF (on weight of fiber): The amount of solids that were applied after drying off the solvent.

ppm: parts per million

WPU (Wet Pick-up): The amount of solution weight that was applied to the fiber before drying off the solvent.

Soil repellency and dry soil resistance: Terms used herein interchangeably to describe the ability to prevent soils from sticking to a fiber. For example, the dry soil may be dirt tracked in by foot traffic.

tpi—turns per inch

EXAMPLES

The following Examples demonstrate the present invention and its capability for use. The invention is capable of other and different embodiments, and its several details are capable of modifications in various apparent respects, without departing from the scope and spirit of the present invention. Accordingly, the Examples are to be regarded as illustrative in nature and non-limiting.

The invention has been described above with reference to the various aspects of the disclosed soil repellency composition, treated fibers, yarns, and textiles, and methods of making the same. Obvious modifications and alterations will occur to others upon reading and understanding the proceeding detailed description. It is intended that the invention be construed as including all such modifications and alterations insofar as they come within the scope of the claims.

Test Methods

Carpet Fiber Soiling Resistance Test

The procedure for drum soiling was adapted from ASTM D6540 and D1776. According to ASTM D6540, soiling tests can be conducted on up to six carpet samples simultaneously using a drum. The base color of the sample (using the L, a, b color space) was measured using the hand held "Chromameter" color measurement instrument sold by Minolta Corporation as "Chromameter" model CR-310. This measurement was the control value. The carpet sample was mounted on a thin plastic sheet and placed in the drum. Two hundred fifty grams (250 g) of dirty Zytel 101 nylon beads (by DuPont Canada, Mississauga, Ontario) were placed on the sample. The dirty beads were prepared by mixing ten grams (3 g) of AATCC TM-122 synthetic carpet soil (by Manufacturer Textile Innovators Corp. Windsor, N.C.) with one thousand grams (1000 g) of new Zytel® 101 beads. One thousand grams (1000 g) of steel ball bearings were added into the drum. The drum was run for 30 minutes with direction reversal after fifteen minutes and then the samples were removed.

Each sample was vacuumed thoroughly and the color was measured as an indicator of soiling, recorded as the color change versus control value (delta E) after vacuuming.

Samples with a high value of delta E perform worse than samples with low delta E value.

Carpet Durability Test

Durability experiments were performed by cleaning a carpet test item with a standard vacuum cleaner for five minutes. The test item, and an identical, but otherwise uncleaned (non-vacuumed) comparison item were then soiled by foot traffic for a given number of traffics. Delta E values for the test item and comparison item were periodically measured. A delta E value that is much greater for the test item indicates a less durable treatment.

Carpet Water Repellency Test

An adapted procedure from the AATCC 193-2007 method was used for water repellency testing. A series of seven different solutions, which each constituting a 'level', are prepared. The compositions of these solutions are listed below in Table 1.

TABLE 1

| Solution Level | Solution Composition |
|---|---|
| 0 | 100% deionized water |
| 1 | 98% deionized water, 2% isopropylalcohol |
| 2 | 95% deionized water, 5% isopropylalcohol |
| 3 | 90% deionized water, 10% isopropylalcohol |
| 4 | 80% deionized water, 20% isopropylalcohol |
| 5 | 70% deionized water, 30% isopropylalcohol |
| 6 | 60% deionized water, 40% isopropylalcohol |

Starting with the lowest level, three drops of solution are pipetted onto the carpet surface. If at least two out of the three droplets remain above the carpet surface for 10 seconds, the carpet passes the level. The next level is then evaluated. When the carpet fails a level, the water repellency rating is determined from the number corresponding to the last level passed. In some instances in this report the value F is listed. The result of F (indicating failed) represents a carpet surface for which 100% deionized water cannot remain above the surface for at least 10 seconds. Other instances may list a level 0 as a synonym to a value F. A result of 0 can also represent a carpet surface for which 100% deionized water remains above the surface for at least 10 seconds, but a solution of 98% deionized water and 2% isopropyl alcohol cannot remain above the surface for at least 10 seconds. A level of 1 would correspond to a carpet for which a solution of 98% deionized water and 2% isopropyl alcohol remains above the surface for at least 10 seconds while a solution of 95% deionized water and 5% isopropyl alcohol cannot remain above the surface for at least 10 seconds.

Carpet Hand Test

The hand or feel of select carpet samples were evaluated by using a panel of approximately ten people to objectively rank the carpet samples, in order of increasing softness. Each participant begins by cleaning his hands with a Clorox® hand wipe. By feeling the carpet, in whatever manner or method he chooses, the participant ranks the carpet samples in order from the softest to the harshest carpet.

Radiant Panel Flame Retardancy Test

Radiant panel testing was done for all carpet samples according to ASTM method E648.

Example 1

The carpet used for testing was 995 denier, Saxony style, cut pile nylon 6,6 carpet (9/16" pile height, 13-14 stitches per inch, 1/8" gauge). The unbacked carpet weight was 46 oz./yd$^2$. The carpet was dyed light wheat beige. The carpet was pretreated by exhaust application of a stainblocker including a polyacrylate resin. The test items were sprayed with Laponite® SL25 at application rates from about 0.4% owf to about 3.0% owf, in order to achieve solids deposition rates owf ranging from about 1000 to about 7500 ppm. The carpet samples were then placed in a convection oven for 10 min at 150° C. to accomplish a curing of the treatment on the carpet fibers. Accelerated soiling was performed on the treated carpet samples according to the Carpet Fiber Soiling Resistance test. The results in Table 2 show the anti-soil performance of the test items, where the averaged delta E values are reported as raw values, and as a percentage of the averaged value determined for the control test item.

TABLE 2

| Item | Sample Treatment | Solids owf (ppm) | Delta E | % Delta E vs. Control |
|---|---|---|---|---|
| A | Control | 0 | 17.9 ± 0.9 | — |
| B | 0.4% owf Laponite ® SL25 | 1000 | 15.1 ± 1.6 | 84% |
| C | 0.8% owf Laponite ® SL25 | 2000 | 14.2 ± 0.7 | 79% |
| D | 1.2% owf Laponite ® SL25 | 3000 | 12.9 ± 1.1 | 72% |
| E | 2.0% owf Laponite ® SL25 | 5000 | 11.4 ± 1.3 | 64% |
| F | 3.0% owf Laponite ® SL25 | 7500 | 11.2 ± 2.0 | 63% |

Example 2

The carpet used for testing was a 2490 denier, two ply, nylon 6,6 loop pile carpet with 4.5 tpi, 1/4" pile height, and 1/10" gauge. The unbacked carpet weight was 32 oz./yd$^2$. The carpet was dyed light wheat beige. The test items were sprayed with Laponite® SL25 at application rates from about 1.25% owf to about 2.25% owf, in order to achieve solids deposition rates owf ranging from about 3125 to about 5625 ppm. The carpet samples were then placed in a convection oven for 10 min at 150° C. to accomplish a curing of the treatment on the carpet fibers. Accelerated soiling was performed on the treated carpet samples according to the Carpet Fiber Soiling Resistance test. The results in Table 3 show the anti-soil performance of the test items, where the averaged delta E values are reported as raw values, and as a percentage of the averaged value determined for the control test item.

TABLE 3

| Item | Sample Treatment | Solids owf (ppm) | Delta E | % Delta E vs. Control |
|---|---|---|---|---|
| G | Untreated Control | — | 10.0 ± 0.4 | — |
| H | 1.25% owf Laponite ® SL25 | 3125 | 5.4 ± 0.5 | 54% |
| I | 1.50% owf Laponite ® SL25 | 3750 | 5.7 ± 0.5 | 57% |
| J | 1.75% owf Laponite ® SL25 | 4375 | 5.8 ± 0.4 | 58% |
| K | 2.00% owf Laponite ® SL25 | 5000 | 5.5 ± 0.4 | 54% |
| L | 2.25% owf Laponite ® SL25 | 5625 | 5.8 ± 0.4 | 58% |

The data in Table 3 shows that the application levels of Laponite® SL25 from 1.25% owf to 2.25% owf offer the same level of soiling protection. This degree of soiling protection exceeds the performance of current commercial carpet fluorochemical treatments at typical use rates of 200-600 ppm elemental fluorine. For comparison, a carpet, treated by spraying a physical blend of Capstone® RCP and a silsesquioxane sol dispersion such that 200 ppm fluorine is deposited on the fiber face will typically yield an anti-soiling performance result measured to be 70-75% of the control measurement, when subjected to the Carpet Fiber Soiling Resistance Test.

Example 3

The carpet used for testing was a polyethylene terephthalate cut pile carpet (two ply, 6 tpi, 5/8" pile height, 1/10" gauge, 12 stitches per inch). The unbacked carpet weight was 70 oz./yd$^2$. Carpet test sample 'M' had no treatment. Carpet test sample 'N' was treated by spraying with 1.0% owf Laponite® SL25 at 15% wet pick up. Carpet test sample 'O' was treated with 2.0% owf Laponite® SL25 at 15% wet pick up. The carpet samples were then placed in a convection oven for 10 min at 150° C. to accomplish a curing of the treatment on the carpet fibers. Accelerated soiling was performed on the treated carpet samples according to the Carpet Fiber Soiling Resistance test. Results for these test items are shown in Table 4.

The data in Table 4 shows that Laponite® SL25 treatments on polyethylene terephthalate carpet in items N and O show surprising benefit for soil repellency. For comparison, carpet treated by spraying 0.6 wt % Capstone® RCP on the carpet pile (item MM) yields an anti-soiling performance result measured to be 42% of the control measurement, when subjected to the Carpet Fiber Soiling Resistance Test. Capstone® RCP is a fluorochemical emulsion made available by E.I. DuPont de Nemours & Co. (Wilmington, Del.). Comparative test item MM achieves rough equivalence with item N, and underperforms compared to item O.

TABLE 4

| Item | Sample Treatment | Solids owf (ppm) | Delta E | % Delta E vs. Control |
|---|---|---|---|---|
| M | Untreated Control | — | 25.4 | — |
| MM | 0.6% owf Capstone ® RCP | — | 10.6 | 42% |
| N | 1.0% owf Laponite ® SL25 | 2500 | 9.8 | 39% |
| O | 2.0% owf Laponite ® SL25 | 5000 | 6.8 | 27% |

Example 4

The carpet used for testing was a 1001 denier, 200 filament, two ply polyethylene terephthalate loop pile carpet (0.118" pile height, 47 stitches per inch, 5/64" gauge). The unbacked carpet weight was 18.3 oz./yd$^2$. Laponite® SL25 was applied as described previously, and carpets processed by placing in a convection oven for 10 min at 150° C. Accelerated soiling was performed on the treated carpet samples according to the Carpet Fiber Soiling Resistance test. Results for these test items are shown in duplicate Trials One and Two in Table 5.

TABLE 5

| Item | Sample Treatment | Inorganic Solids owf (ppm) | Delta E | % Delta E vs. Control |
|---|---|---|---|---|
| | Trial 1 | | | |
| P1 | Untreated Control | — | 17.9 ± 0.8 | — |
| PP1 | 2.9% owf Laponite ® SL25 and Capstone ® RCP | 2400 | 9.7 ± 0.3 | 54% |
| Q1 | 2.9% owf Laponite ® SL25 | 7250 | 12.1 ± 0.5 | 68% |
| | Trial 2 | | | |
| P2 | Untreated Control | — | 17.0 ± 0.4 | — |
| PP2 | 2.9% owf Laponite ® SL25 and Capstone ® RCP | 2400 | 10.0 ± 0.7 | 59% |
| Q2 | 2.9% owf Laponite ® SL25 | 7250 | 11.8 ± 0.6 | 69% |

Example four shows that Laponite® SL25 is effective as a polyethylene terephthalate loop pile carpet fiber surface protectant for soil resistance. Further, Example four shows that a Laponite® SL25 treatment with an application of 2.9% owf on polyester loop pile construction almost matches the soiling performance of a physical blend of Capstone® RCP and 1.2 wt % Laponite SL25, which is a fluorochemical-containing treatment available through INVISTA-Dalton facilities. Comparative items PP1 and PP2 each indicate application on fiber of 360 ppm fluorine as well as deposition of inorganic solids on the fiber face at 2400 ppm application rate. Items Q1 and Q2 demonstrate greatly improved soiling performance as compared to the untreated control carpet items P1 and P2, respectively.

Example 5

The carpet used for testing was polyethylene terephthalate loop pile carpet (1001 denier, 200 filament, 2 ply, with 0.118" pile height, 47 stitches per inch, 5/64" gauge). The unbacked carpet weight was 18.3 oz./yd$^2$. The carpet samples treated with a physical blend of Capstone® RCP and 1.2 wt % Laponite SL25 (Item S) were then placed in a convection oven for 10 min at 150° C. Accelerated soiling was performed on the treated carpet samples according to the Carpet Fiber Soiling Resistance test. Results for these test items are shown in Table 6.

TABLE 6

| Item | Sample Treatment | Inorganic Solids owf (ppm) | Delta E | % Delta E vs. Control |
|---|---|---|---|---|
| R | Untreated Control | — | 16.3 ± 0.6 | — |
| S | Laponite ® SL25 and Capstone ® RCP | 1000 | 11.4 ± 0.7 | 70% |
| T | 1.2% owf Laponite ® SL25 | 3000 | 12.2 ± 0.7 | 75% |

Example five shows that a Laponite® SL25 treatment with an application of 1.2% owf on polyester loop pile construction performs about the same as a physical blend of Capstone® RCP and 1.2 wt % Laponite SL25, applied at 150 ppm elemental fluorine on the fiber face, in terms of anti-soiling performance.

Example 6

The carpet used for testing was 2490 denier, two ply, nylon 6,6 loop carpet (4.5 tpi, 1/4" pile height, 1/10" gauge). The unbacked carpet weighed 32 oz./yd$^2$. The carpet was dyed light wheat beige. Durability experiments were performed by treating two carpet samples, both with 2.0% owf Laponite® SL25 solution using a spray application with a 15% wpu. Two carpet samples were also prepared both with current fluorochemical treatment, having an elemental fluorine level of 150 ppm on the fiber face. All of the treated carpet samples were cured in the oven at 150° C. for 10 minutes. One carpet sample with Laponite® treatment and one sample with a physical blend of Capstone® RCP and 1.2 wt % Laponite SL25 were soiled as described in the Carpet Fiber Soiling Resistance Test. The remaining two carpet samples were aggressively vacuumed for 5 minutes prior to being soiled. The delta E values from both of these methods were measured and used to compare the results from the aggressively vacuumed sample to the results from the non-aggressively vacuumed sample. The data is shown in Table 7.

TABLE 7

| Sample | Method | Delta E | % Delta E vs. Control |
|---|---|---|---|
| Untreated control | Carpet Fiber Soiling Resistance Test | 12.9 ± 0.3 | — |
| Laponite ® SL25 and Capstone ® RCP (150 ppm F) | Carpet Fiber Soiling Resistance Test | 7.5 ± 0.4 | 58% |

TABLE 7-continued

| Sample | Method | Delta E | % Delta E vs. Control |
|---|---|---|---|
| Laponite ® SL25 and Capstone ® RCP (150 ppm F) | Aggressive vacuuming, then Carpet Fiber Soiling Resistance Test | 6.0 ± 0.2 | 47% |
| Untreated control | Carpet Fiber Soiling Resistance Test | 12.0 ± 0.4 | — |
| 2.0% owf Laponite ® SL25 | Carpet Fiber Soiling Resistance Test | 6.8 ± 0.5 | 57% |
| 2.0% owf Laponite ® SL25 | Aggressive vacuuming, then Carpet Fiber Soiling Resistance Test | 5.9 ± 0.5 | 49% |

The data in Table 7 indicate that aggressive vacuuming does not decrease the soiling performance of the Laponite® SL25 treated carpets. This indicates that aggressive vacuuming does not promote the removal of Laponite® SL25 treatments from the carpet surface. Similar performance data is obtained for carpets treated with fluorochemical-containing anti-soil chemicals, suggesting that Laponite® SL25 treatments for carpets have similar durability performance properties as current fluorochemical-containing treatments.

Example 7

The carpet used for testing was 995 denier, saxony style, cut pile nylon 6,6 carpet (9/16" pile height, 13-14 stitches per inch, 1/8" gauge). The unbacked carpet weight was 46 oz./yd$^2$. The carpet was dyed light wheat beige. The carpet was pretreated by exhaust application of a stainblocker including a polyacrylate resin. The test items were sprayed with Laponite® SL25 at application rates from about 0.5% owf to about 5.0% owf, in order to achieve solids deposition rates owf ranging from about 1250 to about 12500 ppm. The carpet samples were then placed in a convection oven for 10 min at 150° C. to accomplish a curing of the treatment on the carpet fibers. Accelerated soiling was performed on the treated carpet samples according to the Carpet Fiber Soiling Resistance test. The results in Table 8 show the anti-soil performance of the test items, where the averaged delta E values are reported as raw values, and as a percentage of the averaged value determined for the control test item.

TABLE 8

| Item | Sample Treatment | Solids owf (ppm) | Delta E | % Delta E vs. Control |
|---|---|---|---|---|
| U | Untreated Control | — | 20.0 ± 1.1 | — |
| V | 0.50% owf Laponite ® SL25 | 1250 | 15.3 ± 0.6 | 77% |
| W | 1.00% owf Laponite ® SL25 | 2500 | 14.3 ± 0.4 | 72% |
| X | 2.00% owf Laponite ® SL25 | 5000 | 11.9 ± 0.5 | 60% |
| Y | 3.00% owf Laponite ® SL25 | 7500 | 11.6 ± 1.5 | 58% |
| Z | 5.00% owf Laponite ® SL25 | 12500 | 9.8 ± 0.5 | 49% |

Example 8

The carpet used for testing was a 2490 denier, two ply, nylon 6,6 loop pile carpet with 4.5 tpi, 1/4" pile height, and 1/10" gauge. The unbacked carpet weight was 32 oz./yd$^2$. The carpet was dyed light wheat beige. The test items in Table 9 were sprayed with Laponite® SL25 at application rates from about 0.5% owf to about 5.0% owf, in order to achieve solids deposition rates owf ranging from about 1250 to about 12500 ppm. The test items in Table 12 were sprayed with Laponite® SL25 at application rates from about 3.0% owf to about 12.0% owf, in order to achieve solids deposition rates owf ranging from about 7500 to about 30000 ppm. The carpet samples from both Tables 9 and 12 were then placed in a convection oven for 10 min at 150° C. to accomplish a curing of the treatment on the carpet fibers. Accelerated soiling was performed on the treated carpet samples according to the Carpet Fiber Soiling Resistance test. The results in Tables 9 and 10 show the anti-soil performance of the test items, where the averaged delta E values are reported as raw values, and as a percentage of the averaged value determined for the control test item.

TABLE 9

| Item | Sample Treatment | Solids owf (ppm) | Delta E | % Delta E vs. Control |
|---|---|---|---|---|
| AA | Untreated Control | — | 9.0 ± 0.3 | — |
| AB | 0.50% owf Laponite ® SL25 | 1250 | 6.3 ± 0.4 | 69% |
| AC | 1.00% owf Laponite ® SL25 | 2500 | 5.3 ± 0.1 | 58% |
| AD | 2.00% owf Laponite ® SL25 | 5000 | 4.3 ± 0.1 | 48% |
| AE | 3.00% owf Laponite ® SL25 | 7500 | 3.8 ± 0.2 | 42% |
| AF | 5.00% owf Laponite ® SL25 | 12500 | 3.0 ± 0.2 | 33% |

TABLE 10

| Item | Sample Treatment | Solids owf (ppm) | Delta E | % Delta E vs. Control |
|---|---|---|---|---|
| AG | Untreated Control | — | 8.4 ± 0.3 | — |
| AH | 3.00% owf Laponite ® SL25 | 7500 | 5.6 ± 0.2 | 66% |
| AI | 5.00% owf Laponite ® SL25 | 12500 | 3.8 ± 0.3 | 46% |
| AJ | 8.00% owf Laponite ® SL25 | 20000 | 3.7 ± 0.3 | 43% |
| AK | 10.00% owf Laponite ® SL25 | 25000 | 3.1 ± 0.3 | 37% |
| AL | 12.00% owf Laponite ® SL25 | 30000 | 3.4 ± 0.4 | 40% |

The data in Tables 9 and 10 show that the increase in application level of Laponite® SL25 from 1.0% owf to 2.0% owf provides the greatest improvement in soiling protection. This degree of soiling protection exceeds the performance of current commercial carpet fluorochemical treatments at typical use rates of 200-600 ppm elemental fluorine. For comparison, a carpet, treated by spraying a physical blend of Capstone® RCP and a silsesquioxane sol dispersion such that 200 ppm fluorine is deposited on the fiber face will typically yield an anti-soiling performance result measured to be 70-75% of the control measurement, when subjected to the Carpet Fiber Soiling Resistance Test. Anti-soiling performance improvement can also be seen with higher application levels of Laponite® SL25 up to 10.0% owf.

Example 9

The carpet used for testing was a polyester cut pile carpet (2 ply, 6 tpi, 5/8" pile height, 1/10" gauge, 12 stitches per inch) dyed a light wheat beige color. The unbacked carpet weight was 70 oz./yd$^2$. Carpet test samples 'AM', 'AS', and 'AY' had no treatment. Carpet test samples 'AN', 'AT', and 'AZ' were sprayed with a combination of Capstone® RCP and Laponite® SL25, such that the elemental fluorine level was 150 ppm. Capstone® RCP is a fluorochemical emulsion made available by E.I. DuPont de Nemours & Co. (Wilmington, Del.). Table 11 shows test items which were sprayed with Laponite® SL25 at application rates from about 0.4% owf to about 1.2% owf, in order to achieve solids deposition rates owf ranging from about 1000 to about 3000 ppm. Table 14 shows test items which were sprayed with Laponite® SL25 at application rates from about 2.0% owf to about 4.0% owf, in order to achieve solids deposition rates owf ranging from about 5000 to about 10000 ppm. Table 15 shows test items which were sprayed with Laponite® SL25 at application rates from about 6.0% owf to about 12.0% owf, in order to achieve solids deposition rates owf ranging from about 15000 to about 30000 ppm. All of the treated carpet samples from Tables 11-13 were then placed in a convection oven for 10 min at 150° C. to accomplish a curing of the treatment on the carpet fibers. Accelerated soiling was performed on the carpet samples according to the Carpet Fiber Soiling Resistance test. The Carpet Hand Test and the Carpet Water Repellency Test were run on the carpet samples. Results for these test items are shown in Tables 11-13.

TABLE 11

| Item | Sample Treatment | Solids owf (ppm) | Hand | Water Repellency | Delta E | % Delta E vs. Control |
|---|---|---|---|---|---|---|
| AM | Untreated Control | — | | 3 | 18.66 ± 0.43 | 100% |
| AN | Laponite ® SL25 and Capstone ® RCP (150 ppm F) | 1000 | No Significant Difference From Control | 3 | 16.42 ± 0.97 | 88% |
| AO | 0.4% owf Laponite ® SL25 | 1000 | No Significant Difference From Control | 3 | 15.80 ± 1.65 | 85% |
| AP | 0.8% owf Laponite ® SL25 | 2000 | No Significant Difference From Control | 3 | 15.82 ± 0.35 | 85% |
| AQ | 1.0% owf Laponite ® SL25 | 2500 | No Significant Difference From Control | 3 | 15.35 ± 0.90 | 82% |
| AR | 1.2% owf Laponite ® SL25 | 3000 | No Significant Difference From Control | 3 | 15.78 ± 1.25 | 85% |

TABLE 12

| Item | Sample Treatment | Solids owf (ppm) | Hand | Water Repellency | Delta E | % Delta E vs. Control |
|---|---|---|---|---|---|---|
| AS | Untreated Control | — | | 3 | 17.30 ± 0.84 | 100% |
| AT | Laponite ® SL25 and Capstone ® RCP (150 ppm F) | 1000 | No Significant Difference From Control | 3 | 14.03 ± 1.15 | 81% |

TABLE 12-continued

| Item | Sample Treatment | Solids owf (ppm) | Hand | Water Repellency | Delta E | % Delta E vs. Control |
|---|---|---|---|---|---|---|
| AU | 2.0% owf Laponite ® SL25 | 5000 | No Significant Difference From Control | 2 | 14.62 ± 0.66 | 85% |
| AV | 2.5% owf Laponite ® SL25 | 6250 | No Significant Difference From Control | 2 | 14.11 ± 1.40 | 81% |
| AW | 3.0% owf Laponite ® SL25 | 7500 | Harsh | 2 | 13.67 ± 1.23 | 79% |
| AX | 4.0% owf Laponite ® SL25 | 10000 | Harsh | 2 | 13.85 ± 1.67 | 80% |

TABLE 13

| Item | Sample Treatment | Solids owf (ppm) | Hand | Water Repellency | Delta E | % Delta E vs. Control |
|---|---|---|---|---|---|---|
| AY | Untreated Control | — | | 3 | 17.02 ± 0.66 | 100% |
| AZ | Laponite ® SL25 and Capstone ® RCP (150 ppm F) | 1000 | No Significant Difference From Control | 3 | 15.08 ± 1.58 | 89% |
| BA | 6.0% owf Laponite ® SL25 | 15000 | Harsh | F | 13.33 ± 0.37 | 78% |
| BB | 8.0% owf Laponite ® SL25 | 20000 | Harsh | F | 10.70 ± 0.94 | 63% |
| BC | 10.0% owf Laponite ® SL25 | 25000 | Harsh | F | 10.43 ± 1.34 | 61% |
| BD | 12.0% owf Laponite ® SL25 | 30000 | Harsh | F | 10.48 ± 1.28 | 62% |

Example 10

The carpet used for testing was a solution dyed polyester cut pile carpet (2 ply, 6 tpi, ⅝" pile height, 1/10" gauge, 12 stitches per inch) extruded with pigments to have an antique white color. The unbacked carpet weight was 50 oz./yd$^2$. Carpet test sample 'BE' had no treatment. Carpet test sample 'BF' was sprayed with a combination of Capstone® RCP and Laponite® SL25, such that the elemental fluorine level was 150 ppm. Capstone® RCP is a fluorochemical emulsion made available by E.I. DuPont de Nemours & Co. (Wilmington, Del.). Table 14 shows test items which were sprayed with Laponite® SL25 at application rates from about 1.2% owf to about 2.0% owf, in order to achieve solids deposition rates owf ranging from about 2500 to about 5000 ppm. All of the treated carpet samples from Table 13 were then placed in a convection oven for 10 min at 150° C. to accomplish a curing of the treatment on the carpet fibers. Accelerated soiling was performed on the carpet samples according to the Carpet Fiber Soiling Resistance test. The Carpet Hand Test and the Carpet Water Repellency Test were run on the carpet samples. Results for these test items are shown in Table 14. The data in Table 14 suggests that 2.0% owf Laponite® SL25 treatment outperforms the Capstone® RCP and Laponite® SL25 combination application (applied at 150 ppm elemental fluorine). In addition, the samples treated with 2.0% owf Laponite® SL25 maintain water repellency with a rating of 3 and have no significant deviations in hand from the untreated control.

TABLE 14

| Item | Sample Treatment | Solids owf (ppm) | Hand | Water Repellency | Delta E | % Delta E vs. Control |
|---|---|---|---|---|---|---|
| BE | Untreated Control | — | | F | 18.27 ± 1.68 | 100% |
| BF | Laponite ® SL25 and Capstone ® RCP (150 ppm F) | 1000 | No significant difference vs. control | 3 | 15.56 ± 1.32 | 86% |
| BG | 1.2% owf Laponite ® SL25 | 2500 | No significant difference vs. control | 3 | 14.66 ± 0.36 | 81% |
| BH | 2.0% owf Laponite ® SL25 | 5000 | No significant difference vs. control | 3 | 12.29 ± 0.53 | 68% |
| BI | 2.0% owf Laponite ® SL25 | 5000 | No significant difference vs. control | 3 | 13.10 ± 0.57 | 72% |
| BJ | 2.0% owf Laponite ® SL25 | 5000 | No significant difference vs. control | 3 | 11.47 ± 0.87 | 63% |

Example 11

The carpet used for testing was a 1200 denier, 90 filament, 2 ply polyester multi loop pile carpet, with a twist of 98S, a 3 mm pile height, 5/64 gauge, and 37.5 stitches per 10 cm. The carpet was dyed a medium brown color. The weight of the carpet without backing was 590 grams per square meter. The carpet 'BR' was untreated, the carpet 'BS' was sprayed with Laponite® SL25 at an application rate of 1.2% owf, the carpet 'BT' was sprayed with Laponite® SL25 at an application rate of 2.0% owf, and the carpet 'BU' was sprayed with Capstone® RCP at an application rate of 500 ppm of elemental fluorine. Capstone® RCP is a fluorochemical emulsion made available by E.I. DuPont de Nemours & Co. (Wilmington, Del.). Radiant panel testing was done for all carpet samples according to ASTM method E648 and results are shown in Table 15. A critical radiant flux of at least 0.45 watts per square centimeter is required to classify a carpet as a class I pass. Table 15 shows that Laponite® SL25 treatments greatly improve the ability of the polyester carpet to pass class I in the radiant panel testing, where the untreated polyester carpet barely passes class I. The results also show that Laponite® SL25 treatments are more effective at improving flame retardancy of the polyester carpet than the Capstone® RCP fluorochemical treatment.

TABLE 15

| Item | Sample Treatment | Flammability Classification | Critical Radiant Flux (watts/sq cm) |
|---|---|---|---|
| BR | Untreated Control | Class I Pass | 0.47 |
| BS | 1.2% owf Laponite ® SL25 | Class I Pass | 0.67 |

TABLE 15-continued

| Item | Sample Treatment | Flammability Classification | Critical Radiant Flux (watts/sq cm) |
|---|---|---|---|
| BT | 2.0% owf Laponite ® SL25 | Class I Pass | 0.76 |
| BU | 500 ppm Capstone ® RCP | Class I Pass | 0.53 |

Example 12

The carpet used for testing was a 1200 denier, 90 filament, 2 ply polyester level loop pile carpet, with a twist of 98S, a 3 mm pile height, 1/12 gauge, and 37.5 stitches per 10 cm. The carpet was dyed a light brown color. The weight of the carpet without backing was 550 grams per square meter. The carpet 'BV' was untreated and the carpet 'BW' was sprayed with Laponite® SL25 at an application rate of 2.0% owf. Radiant panel testing was done for both carpet samples according to ASTM method E648. Results are shown in Table 16. A critical radiant flux of at least 0.45 watts per square centimeter is required to classify a carpet as a class I pass. Table 16 shows that the treatment of Laponite® SL25 greatly improves the ability of the polyester carpet to pass class I in the radiant panel testing, where the untreated polyester carpet barely passes class I.

TABLE 16

| Item | Sample Treatment | Flammability Classification | Critical Radiant Flux (watts/sq cm) |
|---|---|---|---|
| BV | Untreated Control | Class I Pass | 0.45 |
| BW | 2.0% owf Laponite ® SL25 | Class I Pass | 0.59 |

Example 13

The carpet used for testing was a 1200 denier, 90 filament, 2 ply polyester multi loop pile carpet, with a twist of 98S, a 3 mm pile height, 1112 gauge, and 37.5 stitches per 10 cm. The carpet was dyed a light brown color. The weight of the carpet without backing was 550 grams per square meter. The carpet 'BX' was untreated and the carpet 'B' was sprayed with Laponite® SL25 at an application rate of 2.0% owf. Radiant panel testing was done for both carpet samples according to ASTM method E648 and results are shown in Table 17. A critical radiant flux of at least 0.45 watts per square centimeter is required to classify a carpet as a class I pass. Table 17 shows that the treatment of Laponite® SL25 greatly improves the ability of the polyester carpet to pass class I in the radiant panel testing, where the untreated polyester carpet in this example does not pass class land therefore must be classified as a class II pass.

TABLE 17

| Item | Sample Treatment | Flammability Classification | Critical Radiant Flux (watts/sq cm) |
|---|---|---|---|
| BX | Untreated Control | Class II Pass | 0.39 |
| BY | 2.0% owf Laponite ® SL25 | Class I Pass | 0.62 |

The invention claimed is:

1. A fiber comprising a surface treatment for soiling protection, wherein the surface treatment for soiling protection comprises at least one clay nanoparticle component as the only treatment for soiling protection on the fiber, wherein the at least one clay nanoparticle component is present in an amount from about 4500 ppm to about 8000 ppm on the surface of the fiber.

2. The fiber of claim 1 wherein the at least one clay nanoparticle component is selected from the group consisting of: montmorillonite, bentonite, pyrophyllite, hectorite, saponite, sauconite, nontronite, talc, beidellite, volchonskoite, vermiculite, kaolinite, dickite, antigorite, anauxite, indellite, chrysotile, bravaisite, suscovite, paragonite, biotite, corrensite, penninite, donbassite, sudoite, pennine, sepiolite, polygorskyte, and combinations thereof.

3. The fiber of claim 1 wherein the at least one clay nanoparticle component is synthetic.

4. The fiber of claim 3 wherein the at least one clay nanoparticle component is synthetic hectorite.

5. The fiber of claim 1 wherein the fiber is comprised of at least one polyamide resin selected from the group consisting of nylon 6,6, nylon 6, nylon 7, nylon 11, nylon 12, nylon 6,10, nylon 6,12, nylon 6,12, nylon DT, nylon 6T, nylon 61 and blends or copolymers thereof.

6. The fiber of claim 1 wherein the fiber is comprised of at least one polyester resin selected from the group consisting of polyethylene terephthalate, polytrimethylene terephthalate, polybutylene terephthalate, polyethylene naphthalate and blends or copolymers thereof.

7. The fiber of claim 1 wherein the at least one polyester resin is polyethylene terephthalate.

8. The fiber of claim 1 wherein the at least one polyamide resin is nylon 6,6.

9. The fiber of claim 1 further comprising a component selected from the group consisting of silicones, optical brighteners, antibacterial components, anti-oxidant stabilizers, coloring agents, light stabilizers, UV absorbers, basic dyes, and acid dye, and combinations thereof.

10. A textile comprising a fiber from claim 1.

11. A carpet comprising a fiber from claim 1, wherein hand of the carpet is not affected.

12. The carpet of claim 11 wherein the Delta E is about 85% or less than that of an untreated carpet when measured using ASTM D6540.

13. The carpet of claim 11 wherein the Delta E is about 50% or less than that of an untreated carpet when measured using ASTM D6540.

14. The carpet of claim 11 wherein the flame retardancy is improved by about 10% or better when compared to an untreated carpet, wherein the flame retardancy is measured by critical radiant flux using ASTM method E648.

15. The carpet of claim 11 wherein the flame retardancy is improved by about 30% or better when compared to an untreated carpet, wherein the flame retardancy is measured by critical radiant flux using ASTM method E648.

16. A method of making the fiber of claim 1 comprising:

a) applying a surface treatment on the fiber, wherein the surface treatment comprises at least one clay nanoparticle component present in an amount from about 4500 ppm to about 8000 ppm on the surface of the fiber and excludes fluorochemicals; and b) heat curing the fiber.

17. The method of claim 16 wherein the surface treatment is applied using a technique selected from the group consisting of spraying, dipping, exhaustive application, coating, foaming, painting, brushing, and rolling.

18. The method of claim 16 wherein the surface treatment is applied by spraying.

19. The method of claim 16 wherein said at least one clay nanoparticle component is selected from the group consisting of: montmorillonite, bentonite, pyrophyllite, hectorite, saponite, sauconite, nontronite, talc, beidellite, volchonskoite, venniculite, kaolinite, dickite, antigorite, anauxite, indellite, chrysotile, bravaisite, suscovite, paragonite, biotite, corrensite, penninite, donbassite, sudoite, pennine, sepiolite, polygorskyte, and combinations thereof.

20. The method of claim 16 wherein said at least one clay nanoparticle is synthetic hectorite in an amount from about 4500 ppm to about 8000 ppm on the surface of the fiber.

21. The method of claim 16 wherein the fiber is comprised of at least one polyamide resin selected from the group consisting of nylon 6,6, nylon 6, nylon 7, nylon 11, nylon 12, nylon 6,10, nylon 6,12, nylon 6,12, nylon DT, nylon 6T, nylon 61 and blends or copolymers thereof.

22. The method of claim 16 wherein the fiber is comprised of at least one polyester resin selected from the group consisting of polyethylene terephthalate, polytrimethylene terephthalate, polybutylene terephthalate, polyethylene naphthalate and blends or copolymers thereof.

* * * * *